US008281718B2

(12) United States Patent
Rice

(10) Patent No.: US 8,281,718 B2
(45) Date of Patent: Oct. 9, 2012

(54) EXPLOSIVE FOIL INITIATOR AND METHOD OF MAKING

(75) Inventor: Brett Rice, Bloomington, IN (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 252 days.

(21) Appl. No.: 12/651,208

(22) Filed: Dec. 31, 2009

(65) Prior Publication Data

US 2012/0227606 A1 Sep. 13, 2012

(51) Int. Cl.
*F42B 3/10* (2006.01)

(52) U.S. Cl. ..... 102/202.7

(58) Field of Classification Search ..... 102/202.7, 102/202.5, 202.14, 202.6, 202.8, 202.12
See application file for complete search history.

(56) References Cited

U.S. PATENT DOCUMENTS

| | | | | | |
|---|---|---|---|---|---|
| 2,363,254 | A | * | 11/1944 | Lawrence | 102/202.11 |
| 2,415,045 | A | * | 1/1947 | Seavey | 102/275.9 |
| 2,802,421 | A | * | 8/1957 | Horne et al. | 102/202.4 |
| 2,980,019 | A | * | 4/1961 | Noddin | 102/202.11 |
| 4,220,088 | A | * | 9/1980 | Kimura et al. | 102/202.7 |
| 4,586,435 | A | | 5/1986 | Bock | |
| 4,788,913 | A | | 12/1988 | Stroud et al. | |
| 4,840,122 | A | | 6/1989 | Nerheim | |
| 4,862,803 | A | | 9/1989 | Nerheim et al. | |
| 4,869,170 | A | | 9/1989 | Dahmberg et al. | |
| 4,944,225 | A | * | 7/1990 | Barker | 102/202.5 |
| 5,080,016 | A | | 1/1992 | Osher | |
| 5,088,413 | A | * | 2/1992 | Huber et al. | 102/202.5 |
| 5,204,491 | A | * | 4/1993 | Aureal et al. | 102/202.14 |
| 5,370,053 | A | * | 12/1994 | Williams et al. | 102/202.5 |
| 5,431,104 | A | * | 7/1995 | Barker | 102/312 |
| 5,678,856 | A | | 10/1997 | Headley | |
| 5,756,925 | A | * | 5/1998 | Frank et al. | 102/202.7 |
| 5,789,697 | A | * | 8/1998 | Engelke et al. | 102/202.5 |
| 5,942,717 | A | * | 8/1999 | Pathe et al. | 102/202.2 |
| 5,969,286 | A | | 10/1999 | Ward et al. | |
| 6,158,347 | A | * | 12/2000 | Neyer et al. | 102/202.7 |

(Continued)

FOREIGN PATENT DOCUMENTS

EP 0601880 A2 6/1994

OTHER PUBLICATIONS

Mendes, R, et al., "Shock Initiation of Explosives by Micro Slapper", Laboratory of Energetics and detonics, Mechanical Eng. Dept., Fac. of Sciences and Technology, University of Coimbra, 3030-201, Coimbra, Portugal, 8 pages, Sep. 9, 2004.

*Primary Examiner* — Michael Carone
*Assistant Examiner* — Reginald Tillman, Jr.
(74) *Attorney, Agent, or Firm* — Christopher A. Monsey

(57) ABSTRACT

An exploding foil initiator is disclosed and is comprised of a substrate having a conductive bridge, a flyer, a barrel adjacent the flyer and an explosive packed sleeve adjacent the barrel. The flyer is comprised of a material which does not become more ductile upon a rise in temperature, for example a silicon dioxide material. The sleeve is comprised of a thermally compliant material, such as a silicone. The bridge is provided with a necked down section having a defined thickness which is less than the remainder of the bridge deposition.

11 Claims, 2 Drawing Sheets

U.S. PATENT DOCUMENTS

| | | | | |
|---|---|---|---|---|
| 6,234,081 | B1 | 5/2001 | Neyer | |
| 6,601,514 | B1 * | 8/2003 | Bretfeld et al. | 102/202.12 |
| 6,923,122 | B2 * | 8/2005 | Hennings et al. | 102/202.7 |
| 7,021,217 | B2 | 4/2006 | Desai et al. | |
| 7,597,046 | B1 * | 10/2009 | Laib | 102/202.5 |
| 7,921,774 | B1 * | 4/2011 | Reynolds et al. | 102/202.14 |
| 2002/0079030 | A1 * | 6/2002 | Chan et al. | 149/11 |
| 2006/0070547 | A1 | 4/2006 | Combes et al. | |
| 2007/0261583 | A1 | 11/2007 | Nance | |
| 2009/0126592 | A1 | 5/2009 | Mukunoiki et al. | |
| 2009/0151584 | A1 | 6/2009 | Desai | |

* cited by examiner

EXPLOSIVE FOIL INITIATOR AND METHOD OF MAKING

STATEMENT REGARDING FEDERALLY SPONSORED RESEARCH OR DEVELOPMENT

The invention described herein was made in the performance of official duties by employees of the Department of the Navy and may be manufactured, used and licensed by or for the United States Government for any governmental purpose without payment of any royalties thereon.

BACKGROUND OF THE INVENTION

Explosive foil initiators generally include plural components, namely a substrate having a bridge, a flyer overlying the bridge, a barrel, and a sleeve containing a secondary explosive. Normally, the flyer is comprised of a polyimide material and the sleeve is comprised of a rigid material, particularly stainless steel.

The present EFI designs may have difficulty operating at elevated temperatures (200° C. and above). It has been demonstrated that at higher temperatures the explosive can actually expand longitudinally into the barrel from the sleeve, which in effect shortens the length the barrel. Secondly, the flyer can become ductile, causing a tearing of the material as opposed to a clean fracture.

SUMMARY OF THE INVENTION

The present disclosure provides an explosive foil initiator (EFI), comprising a substrate having a foil or conductive bridge, the bridge having leads connectable to a firing cable; a flyer positioned against the bridge, the flyer being composed of a ceramic material; a barrel having an opening therethrough and positioned against the flyer; and a sleeve including an explosive material positioned therein and positioned against the barrel, with the barrel opening substantially aligned with the explosive material.

In another embodiment, an explosive foil initiator (EFI), comprises a substrate having a foil or conductive bridge, the bridge having leads connectable to a firing cable; a flyer positioned against the bridge; a barrel having an opening therethrough and positioned against the flyer; a sleeve including an explosive material positioned therein and positioned against the barrel, with the barrel opening substantially aligned with the explosive material and wherein the sleeve is comprised of a high temperature thermally compliant material.

In another embodiment, an explosive foil initiator (EFI), comprises a substrate having a conductive bridge, the bridge having leads connectable to a firing cable. The bridge has conductive lands having a first thickness of conductive material extending towards a center of the substrate, and a necked down section having a second and reduced thickness of material. A flyer is positioned against the conductive bridge and overlies the necked down section, where the flyer is composed of a material that exhibits less than a 10% increase in ductility at 200° C. A barrel is positioned against the flyer and has an opening therethrough. A sleeve includes an explosive material therein positioned against the barrel, with the barrel opening substantially aligned with the explosive material.

In an inventive method of making an explosive foil initiator (EFI), the steps are comprised of providing a substrate having a foil or conductive bridge with leads connectable to a firing cable; providing a flyer composed of a ceramic material; positioning the ceramic flyer against the bridge; providing a barrel having an opening therethrough; positioning the barrel against the flyer; providing a sleeve; depositing an explosive material in the sleeve; and positioning the sleeve against the barrel, with the barrel opening substantially aligned with the explosive material.

In another inventive method of making an explosive foil initiator (EFI), the steps are comprised of providing a substrate having a foil or conductive bridge with leads connectable to a firing cable; providing a flyer; positioning the flyer against the bridge; providing a barrel having an opening therethrough; positioning the barrel against the flyer; providing a sleeve comprised of a high temperature thermally compliant material; depositing an explosive material in the sleeve; and positioning the sleeve against the barrel, with the barrel opening substantially aligned with the explosive material.

A method of using an explosive foil initiator (EFI), comprises the steps of providing a substrate having a conductive bridge with leads connectable to a firing cable; providing a flyer; positioning the flyer against the conductive bridge; providing a barrel having an opening therethrough; positioning the barrel adjacent to the flyer; positioning an explosive material adjacent the barrel opening; and allowing the explosive material to radially expand upon rising temperature.

DETAILED DESCRIPTION OF THE EMBODIMENT

Figure 1:
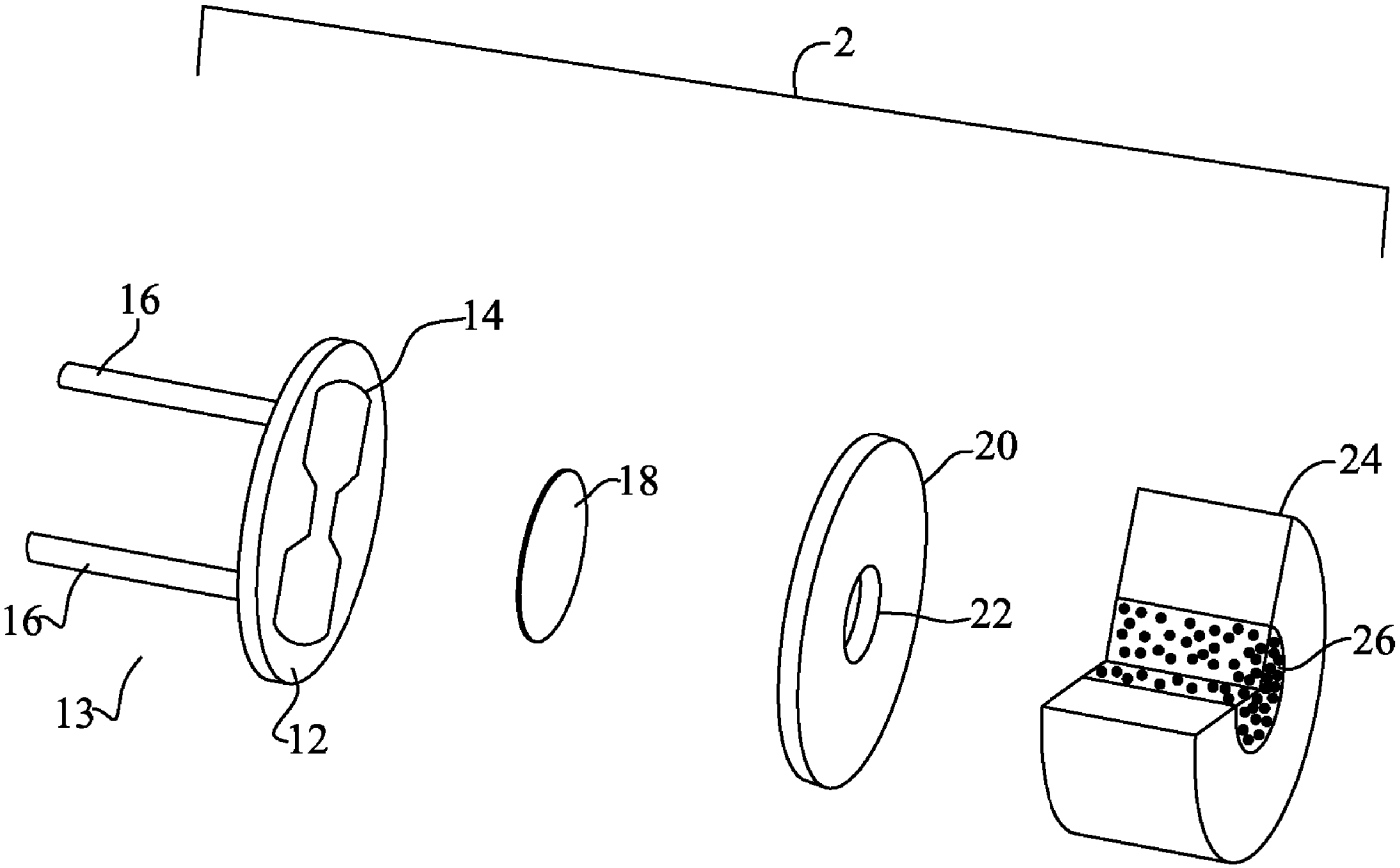
FIG. 1 is an exploded perspective view of an EFI according to the present disclosure.

With reference first to FIG. 1, an exploded view of the exploding foil initiator (EFI) is shown at 2, where EFI 2 is designed to set off a larger charge of explosives. EFI 2 is comprised of a substrate 12 having a conductive bridge 14 deposited thereon. EFI 2 further comprises a flyer 18, a barrel 20 and a sleeve 24. As shown in FIG. 1, bridge 14 is shown in an hourglass configuration, and substrate 12 is shown as a disc shape. As should be understood, other configurations are also possible. It should also be understood that substrate 12 and the other components could be positioned within an enclosure, such as a housing, and could be encapsulated and sealed therein.

Bridge 14 includes electrical leads 16 which, while shown as wire conductors, could take on any form. For example, leads could be in the form of circuit board traces, printed circuit board pins, or could also be connected to connectors which simplify connection. EFI 2 will be connected to a firing initiator, via leads 16, for activation of bridge 14, as described herein.

When assembled, flyer 18 is positioned adjacent to substrate 12 and overlying bridge 14. Barrel 20 is positioned against flyer 18 and barrel 20 includes a chamber 22. Sleeve 24 has an explosive 26 deposited therein, and sleeve 24 is positioned adjacent to barrel 20 with explosive 26 aligned with chamber 22. In typical operation, EFI 2 will be connected to a firing for activation of bridge 14, as described herein.

Figure 2:
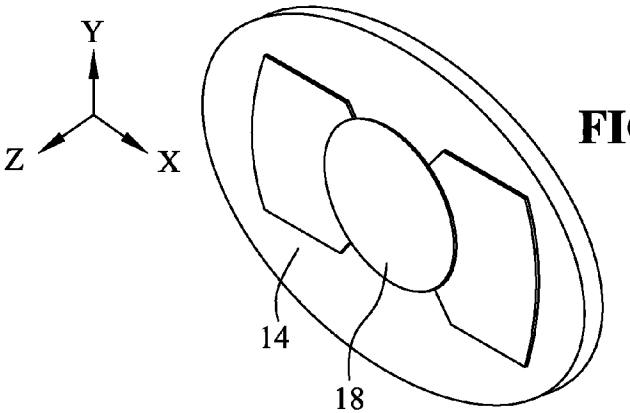
FIG. 2 is a perspective view of the substrate containing the EFI bridge.
Figure 4:
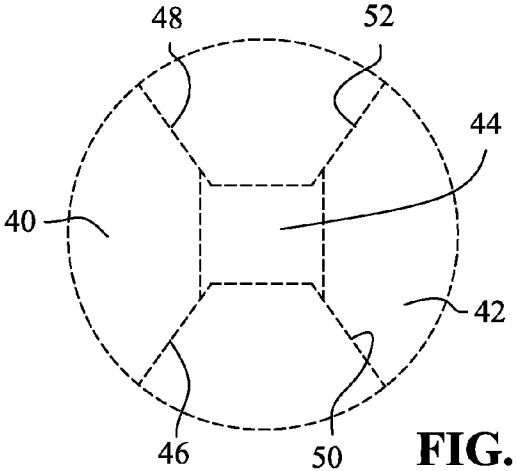
FIG. 4 is an enlarged view of the portion of the bridge denoted in FIG. 3.
Figure 3:
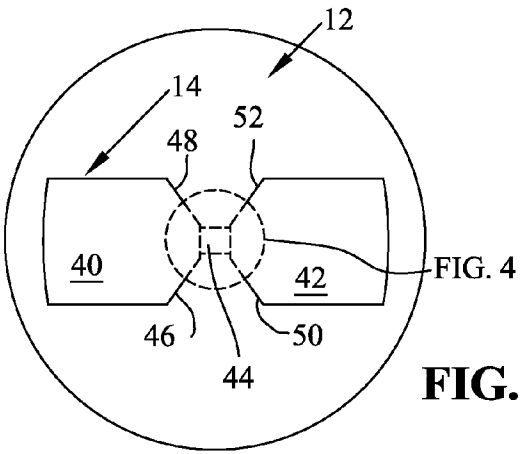
FIG. 3 is a plan view of the EFI of FIG. 2.

With reference now to FIGS. 2 and 3, substrate 12 is shown with bridge 14 deposited thereon with flyer 18 shown in position. As best shown in FIG. 3, bridge 14 is comprised of lands 40 and 42 deposited on substrate 12. Lands 40 and 42 intersect at necked down portion 44. As shown, substrate 12 may be a ceramic material, for example, an alumina ceramic provided by CoorsTek, and more particularly could be CoorsTek Superstrate® 996. As also shown, lands 40 and 42 are deposited copper having a thickness of approximately 25 microns. As shown, necked down area 44 has a length and height of approximately 0.008 inches in both directions, however has a deposited thickness of approximately 1.8 microns of copper.

Land 140 is defined by edges 46 and 48, and land 42 is defined by edges 50 and 52. As shown, lands 40 and 42 flank the necked down section 44. Due to the edges 46, 48 and 50, 52 leading into the necked down section 44, the lands 40, 42 define progressive reductions in conductive material volume leading into the necked down section 44.

Necked down section 44 provides a good definition of the area for the plasma explosion. Said differently, the copper thickness up to the necked down section is 25 microns, and as described above, is reduced in two dimensions (in the x-y directions) up to the necked down section. The necked down section 44 is reduced in the Z direction to increase the resistance within the necked down section. As the necked down area 44 reduces to a thickness of 1.8 microns from 25 microns, the area for the plasma explosion is well defined, providing a discretely focused area for explosion.

As also shown, flyer 18 is comprised of a material that can withstand a high temperature explosion. The flyer 18 may withstand temperatures greater than 100° C. and up to approximately 200° C. The flyer 18 may also be comprised of a material that exhibits less than a 10% increase in ductility at a temperature of 200° C. As shown, flyer 18 is comprised of a ceramic material, and it could be a material including silica, such as silicon dioxide, essentially glass.

Also as shown sleeve 24 is comprised of a thermally expandable material, which can also withstand an explosion of greater than 100° C., and approximately up to 200° C. As disclosed sleeve 24 is radially compliant and could be a material such as silicone.

In operation then, the EFI operates by initiating the firing cable to apply a current to leads 16. As leads 16 are electrically connected to lands 40 and 42, a charge is applied across necked down portion 44, (FIG. 3). Due to the decreasing conductive volume at the necked down portion 44, a plasma explosion occurs. This coupled with the silicon dioxide flyer provides a discretely sheared portion of the flyer upon plasma explosion.

The sheared portion of the flyer 18 travels down the barrel chamber 22 and is accelerated through the chamber 22 with sufficient speed and energy to directly initiate the explosive 26 upon impact. Moreover, as the sleeve 24 is allowed to thermally expand, the explosive 26 radially expands, allowing the fractured portion of the flyer 18 to accelerate the entire length of the barrel prior to contacting the explosive 26.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. An explosive foil initiator (EFI), comprising:

a substrate having a conductive bridge, the bridge having leads connectable to a firing cable;

a flyer positioned against the conductive bridge, the flyer being composed of a ceramic material;

a barrel having an opening therethrough and positioned against the flyer; and a sleeve including an explosive material positioned therein and positioned against the barrel, with the barrel opening substantially aligned with the explosive material, wherein the sleeve is formed with a radially compliant material adapted to permit radial expansion of the explosive material in a high temperature environment up to 200° C.;

wherein the bridge comprises a first, second and third section, said first and second sections comprise conductive lands of material opposing and flanking said third section, said third section comprises a necked down section;

wherein the conductive lands of material are deposited thereon and define progressive reductions in volume of conductive material leading into the necked down section;

wherein the conductive lands have a thickness in the range of 20-30 microns of deposited copper;

wherein the necked down section has a thickness in the range of 1-4 microns of deposited copper;

wherein the flyer is comprised of silica material.

2. The EFI of claim 1, wherein the flyer is silicon dioxide.

3. The EFI of claim 1, wherein the sleeve is comprised of silicone.

4. A method of making an explosive foil initiator (EFI), comprising the steps of:

providing a substrate having a conductive bridge with leads connectable to a firing cable;

providing a flyer composed of a ceramic material;

positioning the ceramic flyer against the conductive bridge;

providing a barrel having an opening therethrough;

positioning the barrel against the flyer;

providing a sleeve;

depositing an explosive material in the sleeve; and positioning the sleeve against the barrel, with the barrel opening substantially aligned with the explosive material, wherein the sleeve is formed with a radially compliant material adapted to permit radial expansion of the explosive material in a high temperature environment up to 200° C.;

wherein the bridge comprises conductive lands of material flanking the necked down section;

wherein the conductive lands of material are deposited thereon and define progressive reductions in volume of conductive material leading into the necked down section;

wherein the conductive lands have a thickness in the range of 20-30 microns of deposited copper;

wherein the necked down section has a thickness in the range of 1-4 microns of deposited copper;

wherein the flyer is provided as a silica material.

5. The EFI of claim 4, wherein the flyer is provided as a silicon dioxide material.

6. The EFI of claim 4, wherein the sleeve is provided as a silicone.

7. A method of using an explosive foil initiator (EFI), comprising the steps of:

providing a substrate having a conductive bridge with leads connectable to a firing cable;

providing a flyer;

positioning the flyer against the conductive bridge;

providing a barrel having an opening therethrough;

positioning the barrel adjacent to the flyer;

positioning a radially expandable sleeve;

positioning an explosive material within said radially expandable sleeve and adjacent the barrel opening, wherein the sleeve is formed with a radially compliant material adapted to permit radial expansion of the explosive material in a high temperature environment up to 200° C.; and allowing the explosive material to radially expand upon rising temperature;

wherein the bridge comprises conductive lands of material flanking the necked down section;

wherein the conductive lands of material are deposited thereon and define progressive reductions in volume of conductive material leading into the necked down section;

wherein the conductive lands have a thickness in the range of 20-30 microns of deposited copper;

wherein the necked down section has a thickness in the range of 1-4 microns of deposited copper;

wherein the flyer is provided as a silica material.

8. The method of claim 7, wherein the radially expandable sleeve is provided as a silicone material.

9. The method of claim 7, wherein the flyer is provided as a silicon dioxide material.

10. An explosive foil initiator (EFI), comprising:

a substrate having a conductive bridge, the bridge having leads connectable to a firing cable, the bridge having conductive lands having a first thickness of conductive material extending towards a center of the substrate, and a necked down section having a second and reduced thickness of material;

a flyer positioned against the conductive bridge and overlying the necked down section, the flyer being composed of a material that exhibits less than a 10% increase in ductility at 200° C.;

a barrel having an opening therethrough and positioned against the flyer; and a sleeve including an explosive material positioned therein and positioned against the barrel, with the barrel opening substantially aligned with the explosive material; wherein the sleeve is formed with a radially compliant material adapted to permit radial expansion of the explosive material in a high temperature environment up to 200° C.;

wherein the conductive lands of material are deposited thereon and define progressive reductions in volume of conductive material leading into the necked down section;

wherein the conductive lands have a thickness in the range of 20-30 microns of deposited copper;

wherein the necked down section has a thickness in the range of 1-4 microns of deposited copper;

wherein the flyer is comprised of silica material.

11. The EFI of claim 10, wherein the flyer is silicon dioxide.

* * * * *